US011035315B2

(12) United States Patent
Bidner et al.

(10) Patent No.: US 11,035,315 B2
(45) Date of Patent: Jun. 15, 2021

(54) MODELING TO COMPENSATE FOR HEGO SENSOR DRIFT

(71) Applicant: Ford Global Technologies, LLC, Dearborn, MI (US)

(72) Inventors: David Karl Bidner, Livonia, MI (US); Stephen William Magner, Farmington Hills, MI (US); William Charles Ruona, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/586,822

(22) Filed: Sep. 27, 2019

(65) Prior Publication Data

US 2021/0095612 A1 Apr. 1, 2021

(51) Int. Cl.
*F02M 1/00* (2006.01)
*F02D 41/30* (2006.01)

(52) U.S. Cl.
CPC ..... *F02D 41/30* (2013.01)

(58) Field of Classification Search
CPC ..... F02D 41/0235; F02D 41/1454; F02D 41/1455; F02D 41/1461
USPC ..... 123/434, 672, 673, 698
See application file for complete search history.

(56) References Cited

U.S. PATENT DOCUMENTS

| | | | | |
|---|---|---|---|---|
| 5,433,071 | A | 7/1995 | Willey et al. | |
| 5,795,545 | A | 8/1998 | Koripella et al. | |
| 2002/0062641 | A1* | 5/2002 | Shiino | F01N 3/0842 60/286 |
| 2005/0050881 | A1* | 3/2005 | Toshioka | F01N 3/0253 60/285 |
| 2007/0234708 | A1 | 10/2007 | Jones et al. | |
| 2016/0237875 | A1* | 8/2016 | Hagiwara | F02D 41/0235 |
| 2019/0063355 | A1* | 2/2019 | Hayashita | F02D 41/1479 |

* cited by examiner

*Primary Examiner* — John Kwon
(74) *Attorney, Agent, or Firm* — Geoffrey Brumbaugh; McCoy Russell LLP

(57) ABSTRACT

The present description relates generally to methods and systems to compensate for oxygen sensor drift caused by hydrogen diffusion within the exhaust system. In one example, a method includes adjusting a fuel amount supplied to an engine based on an estimated amount of hydrogen in the reference cell of an oxygen sensor. In this way, oxygen sensor bias on sensed AFR may be corrected.

13 Claims, 8 Drawing Sheets

MODELING TO COMPENSATE FOR HEGO SENSOR DRIFT

FIELD

The present description relates generally to methods and systems to compensate for HEGO sensor drift caused by hydrogen diffusion within the exhaust system.

BACKGROUND/SUMMARY

Engines combust fuel at specific air to fuel ratios (AFRs) to maintain efficient combustion and reduced emissions. Vehicles may use an exhaust gas sensor, such as a heated exhaust gas oxygen (HEGO) sensor, downstream of a catalyst to control the AFR to near stoichiometry. This is achieved by regulating the AFR based on a difference between HEGO output (e.g., voltage) from a pre-determined HEGO output (e.g., corresponding to stoichiometry). Thus, HEGO sensors provide a feedback adjustment to maintain a setpoint AFR.

Although such emissions control systems have been found to be useful, the accuracy and effectiveness of such systems may be impaired with use over time and component degradation. The combustion of air/fuel mixtures produces an exhaust gas stream comprised of various gaseous components including hydrogen (H2). Hydrogen in the exhaust gas may lead to issues, such as the promotion of ammonia formation. U.S. Pat. No. 5,433,071A (Willey et al., herein after Willey) discloses that the removal of hydrogen from the exhaust gas stream eliminates lean shifts and allows the oxygen sensor and closed loop control means to more accurately control AFR.

However, the inventors herein have recognized issues with the above approach. The approach described in Willey uses a dedicated catalyst to preferentially oxidize hydrogen from the exhaust stream, which is expensive and may not remove all hydrogen under all conditions. If hydrogen remains in the exhaust gas, the hydrogen may cause a bias in the output of one or more oxygen sensors, which may compromise emissions control.

The inventors herein have identified methods and systems which overcome the deficiencies of the approaches described above. In one embodiment, a method includes adjusting a fuel amount supplied to an engine based on an estimated amount of hydrogen in a reference cell of an oxygen sensor positioned in an exhaust passage coupled to the engine. The amount of hydrogen in the reference cell may be determined, in a temporal manner, by modeling the diffusion of hydrogen into and out of the HEGO reference cell which may then be used to trigger intentional lean shifts and/or correct the sensed AFR, thereby accounting for potential HEGO sensor drift without requiring expensive, hardware-based solutions that can create additional failures within the fuel system.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
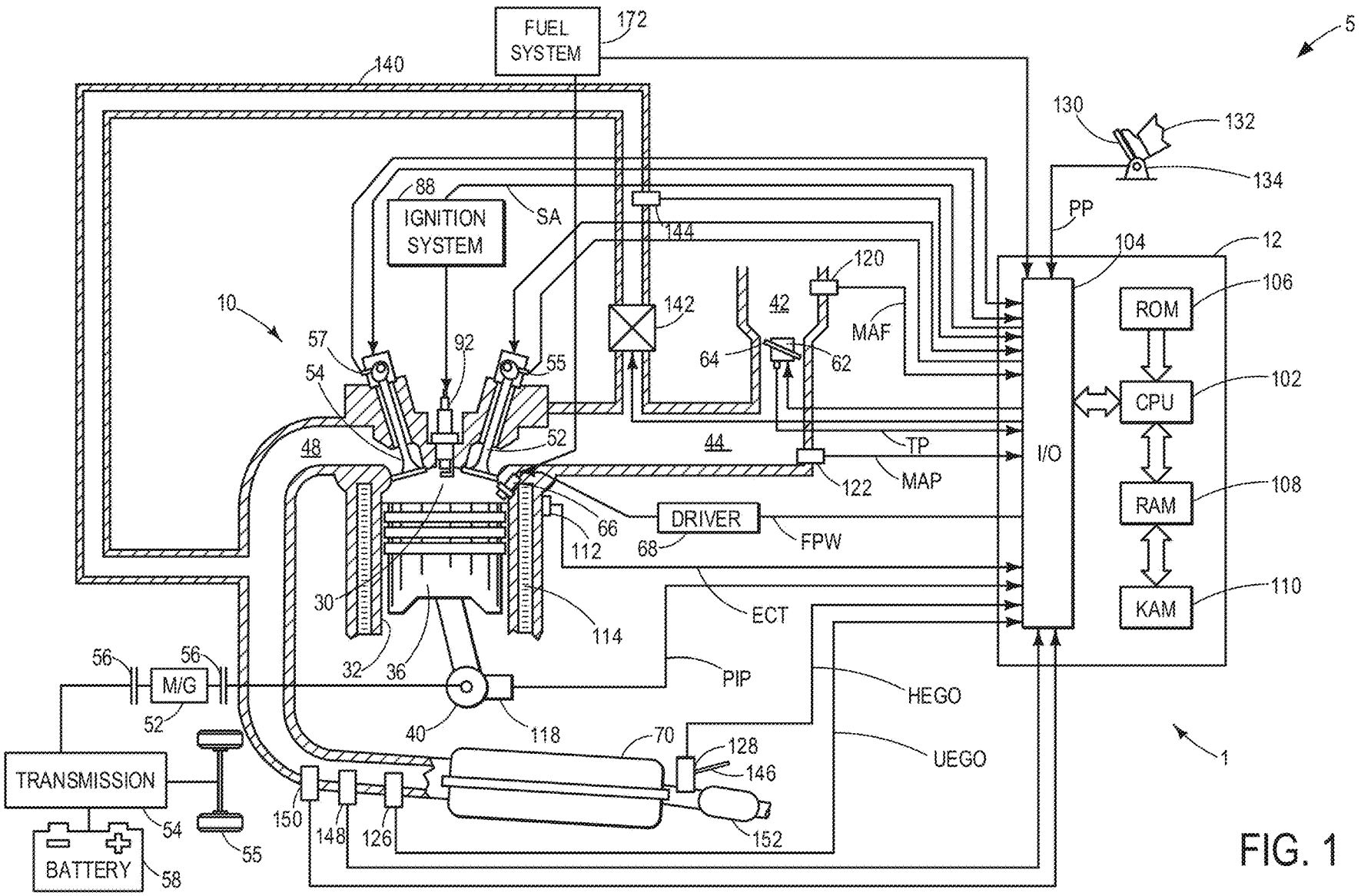
FIG. 1 shows a schematic depiction of an engine system of a vehicle.

The following description relates to systems and methods for modeling hydrogen diffusion into and out of an oxygen sensor's reference cell, such as that of a heated exhaust gas oxygen (HEGO) sensor, to identify and compensate for HEGO sensor drift caused by hydrogen infiltration into the reference cell. Though utilized to sense oxygen, HEGO sensors have a cross-sensitivity to hydrogen. The low molecular weight of hydrogen may allow it to preferentially diffuse through cracks and/or seals in the HEGO sensor and enter into the reference cell of the HEGO sensor. The hydrogen in the reference cell causes the HEGO sensor to detect a leaner mixture than is actually present in the exhaust stream thereby leading to inaccurate AFR control. Further, because hydrogen is generated at rich air-fuel ratio conditions, the HEGO sensor detecting a leaner-than-actual air-fuel ratio may lead to even more hydrogen generation, as the amount of fuel provided to the engine may be increased in an attempt to bring the air-fuel ratio back to (detected) stoichiometry, thus causing more hydrogen to be generated. Additionally, this excess hydrogen generation may lead to ammonia formation, thus increasing emissions, and potentially altering the HEGO sensor's surface that is exposed to exhaust, further desensitizing the HEGO to the magnitude of reductant in the exhaust.

Gas that enters the HEGO sensor reference cell undergoes an electrochemical reaction that causes a change in the output of the sensor. The output of the HEGO sensor may then be used to adjust the vehicle's AFR for optimal vehicle operation and clean emissions. Thus, any hydrogen that enters the HEGO sensor reference cell may bias sensor output thereby impacting the AFR. Hydrogen may relatively rapidly diffuse in the reference cell, driven by the difference in pressure and temperature between the exhaust stream and the reference cell. Diffusion of hydrogen from the reference cell to ambient air may occur over a longer time period, however, as the hydrogen travels down the length of a breather tube attached to the reference cell to exit to ambient air. By modeling the timing of hydrogen movement into and out of the reference cell, a temporal model of the effect of hydrogen on the HEGO sensor response can be determined. This temporal model can then be used to correct the sensed air fuel ratio and thereby correct for any bias in HEGO sensor output due to hydrogen contamination of the reference cell. As used herein, the term "temporal model" may include an estimate of hydrogen concentration in the reference cell that reflects the amount of time that it takes for the hydrogen to diffuse out of the reference cell, which may be longer than the amount of time it takes for hydrogen to diffuse into the reference cell. In this way, even if operating conditions change and hydrogen is no longer present in the exhaust gas traveling through the exhaust passage and past the HEGO sensor, hydrogen may still be present in the reference cell of the HEGO sensor. By using the temporal model, this additional time where hydrogen is present in the reference cell but not the exhaust gas may be accounted for, which may increase the accuracy of the detection and compensation of the hydrogen in the reference cell of the HEGO sensor.

Figure 3:
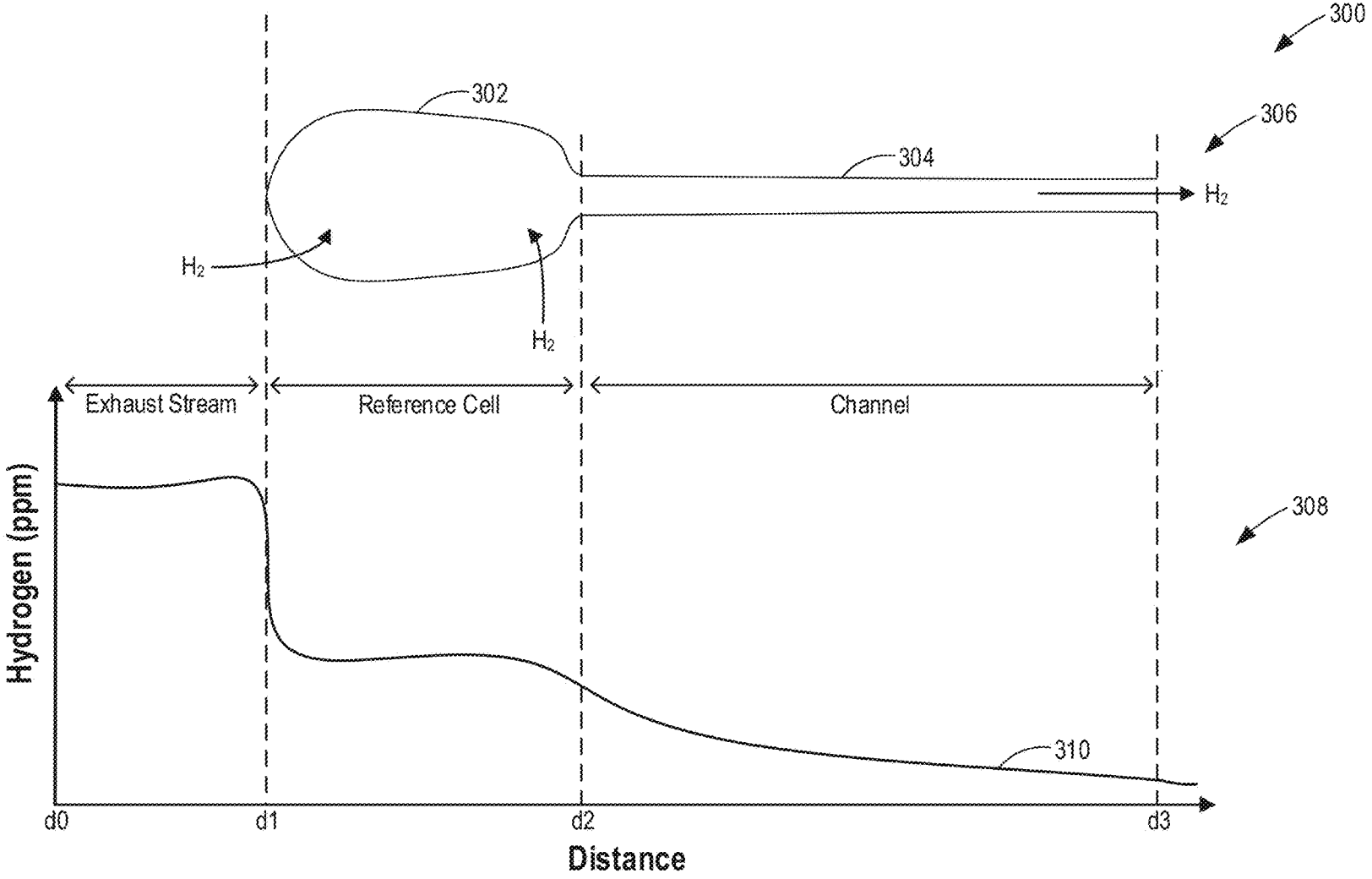
FIG. 3 depicts an example physical model of hydrogen infiltration into an oxygen sensor.
Figure 4:
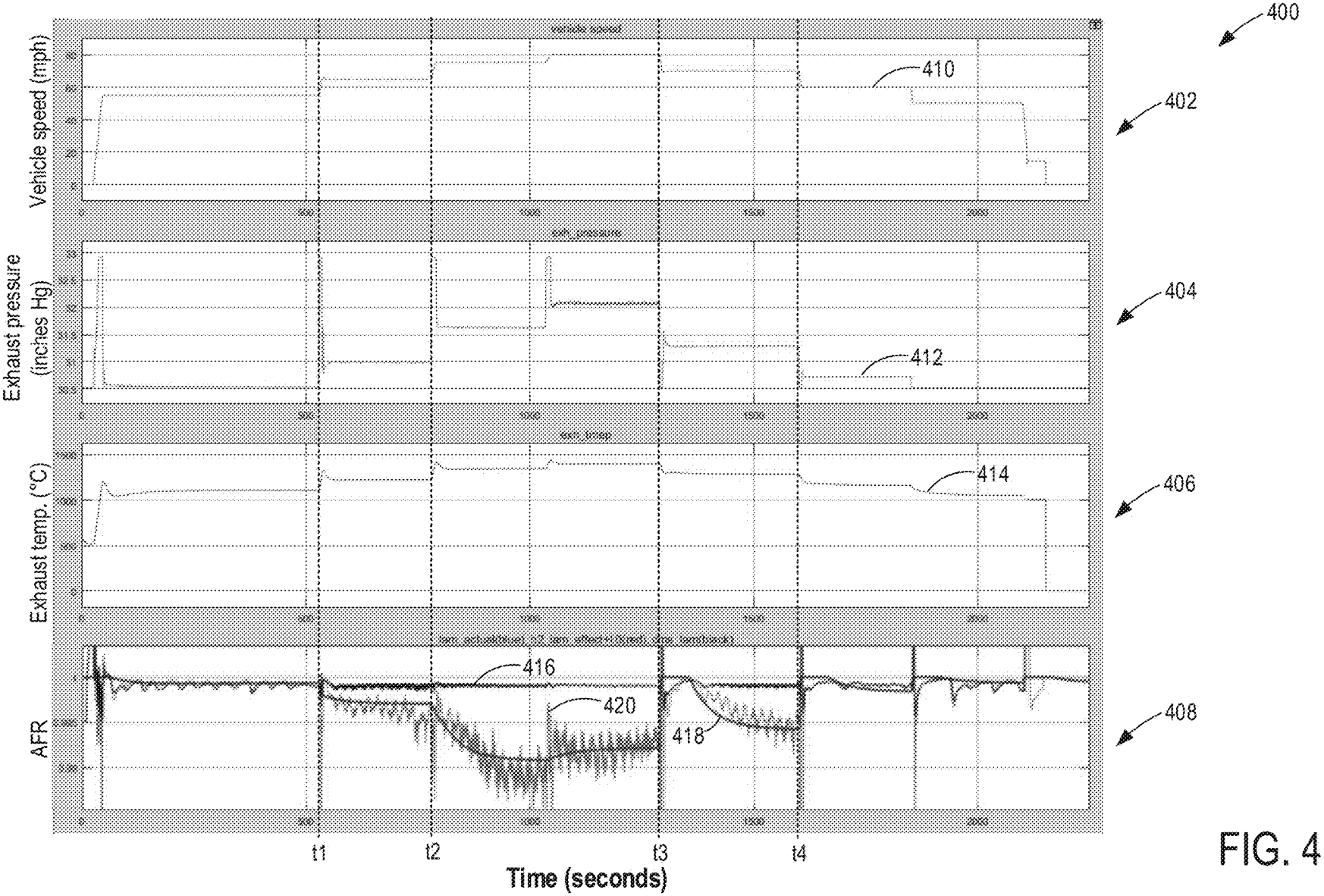
FIG. 4 shows a set of graphs illustrating the effect of hydrogen diffusion on AFR.

As shown in FIG. 1, an engine system may include a HEGO sensor downstream of an emission control device. A schematic cross section of an example oxygen sensor, which may be a HEGO sensor, indicating its key components, including the reference cell, is provided in FIG. 2. Though construction of the HEGO sensor is optimized to prevent any exhaust from contaminating the reference cell, minor leaks can occur. A higher pressure and temperature differential exists between the exhaust stream and the HEGO reference cell that can drive hydrogen diffusion through such leaks. A physical model of hydrogen diffusion into and out the HEGO reference cell is illustrated in FIG. 3 and further demonstrated in FIG. 4. FIG. 4 shows the effect of hydrogen diffusion into the HEGO reference cell on sensed AFR as compared to actual AFR. By modeling diffusion of hydrogen into and out of the reference cell in a control system, a temporal model of HEGO offset due to hydrogen can be determined and utilized to adjust engine fuel amounts as outlined in FIGS. 5 and 6. Example plots of instances of model-based fuel adjustments under different driving conditions is shown in FIG. 7.

FIG. 1 illustrates a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. The pressure and temperature within exhaust passage 48 may be determined by an exhaust pressure sensor 148 and exhaust temperature sensor 150, respectively. Intake manifold 44 and exhaust passage 48 can selectively communicate with combustion chamber 30 via respective intake valve 52 and exhaust valve 54. In some embodiments, combustion chamber 30 may include two or more intake valves and/or two more exhaust valves. In this example, intake valve 52 and exhaust valve 54 may be controlled by cam actuation via one or more cams and may utilize one or more of cam profile switching (CPS), variable cam timing (VCT), variable valve timing (VVT), and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

In some embodiments, each cylinder of engine 10 may be configured with one or more fuel injectors for providing fuel thereto. As a non-limiting example, cylinder 30 is shown including one fuel injector 66, which is supplied fuel from fuel system 172. Fuel injector 66 is shown coupled directly to cylinder 30 for injecting fuel directly therein in proportion to the pulse width of signal FPW received from controller 12 via electronic driver 68. In this manner, fuel injector 66 provides what is known as direct injection (hereafter also referred to as "DI") of fuel into combustion cylinder 30.

It will be appreciated that in an alternate embodiment, injector 66 may be a port injector providing fuel into the intake port upstream of cylinder 30. It will also be appreciated that cylinder 30 may receive fuel from a plurality of injectors, such as a plurality of port injectors, a plurality of direct injectors, or a combination thereof.

Continuing with FIG. 1, intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

An upstream exhaust gas sensor 126 is shown coupled to exhaust passage 48 upstream of emission control device 70. Upstream sensor 126 may be any suitable sensor for providing an indication of exhaust gas air-fuel ratio such as a linear wideband oxygen sensor or UEGO (universal or wide-range exhaust gas oxygen), a two-state narrowband oxygen sensor or EGO, a HEGO (heated EGO), a NOx, HC, or CO sensor. In one embodiment, upstream exhaust gas sensor 126 is a UEGO configured to provide output, such as a voltage signal, that is proportional to the amount of oxygen present in the exhaust. Controller 12 uses the output to determine the exhaust gas air-fuel ratio (AFR).

Emission control device 70 is shown arranged along exhaust passage 48 downstream of exhaust gas sensor 126. Device 70 may be a three way catalyst (TWC), configured to reduce NOx and oxidize CO and unburnt hydrocarbons. In some embodiments, device 70 may be a NOx trap, various other emission control devices, or combinations thereof. Downstream of emission control device 70 is a selective catalytic reduction (SCR) device 152. SCR device 152 may be a passive SCR device that stores ammonia generated in a TWC (e.g., in the emission control device 70) during slightly rich conditions, and the stored ammonia may then be used to reduce NOx emissions when the engine switches to lean operation. In some examples, the SCR device 152 may be the only NOx-controlling device in the exhaust system, e.g., there may not be a NOx trap in the exhaust system. In some examples, emission control device 70 may be a TWC and the only emission control devices present in the exhaust system may be the TWC and the SCR device. In other examples, the exhaust system may include a TWC, an SCR device, and a particulate filter, and no other emission control devices.

A second, downstream exhaust gas sensor 128 is shown coupled to exhaust passage 48 downstream of emissions control device 70. Downstream sensor 128 may be any suitable sensor for providing an indication of exhaust gas air-fuel ratio such as a UEGO, EGO, HEGO, etc. Downstream sensor 128 may have a breather tube 146 attached to an internal reference cell. Breather tube 146 terminates in ambient air. Breather tube 146 may couple the internal reference cell in downstream sensor 128 to ambient air. In one embodiment, downstream sensor 128 is a HEGO configured to indicate the relative enrichment or enleanment of the exhaust gas after passing through the catalyst. As such, the HEGO sensor may provide output in the form of a switch point, or the voltage signal at the point at which the exhaust gas switches from lean to rich.

Further, in the disclosed embodiments, an exhaust gas recirculation (EGR) system may route a desired portion of exhaust gas from exhaust passage 48 to intake passage 42 via EGR passage 140. The amount of EGR provided to intake passage 42 may be varied by controller 12 via EGR valve 142. Further, an EGR sensor 144 may be arranged within the EGR passage and may provide an indication of one or more of pressure, temperature, and concentration of the exhaust gas. Under some conditions, the EGR system may be used to regulate the temperature of the air and fuel mixture within the combustion chamber.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure (MAP) signal from sensor 122. Engine speed signal, RPM, may be generated by controller 12 from signal PIP.

Storage medium read-only memory 106 can be programmed with computer readable data representing non-transitory instructions executable by processor 102 for performing the methods described below as well as other variants that are anticipated but not specifically listed.

As described above, FIG. 1 shows only one cylinder of a multi-cylinder engine, and each cylinder may similarly include its own set of intake/exhaust valves, fuel injector, spark plug, etc. Oxygen sensors are frequently used in internal combustion engines (FIG. 1) to provide indications of various constituents in gasses.

Figure 2:
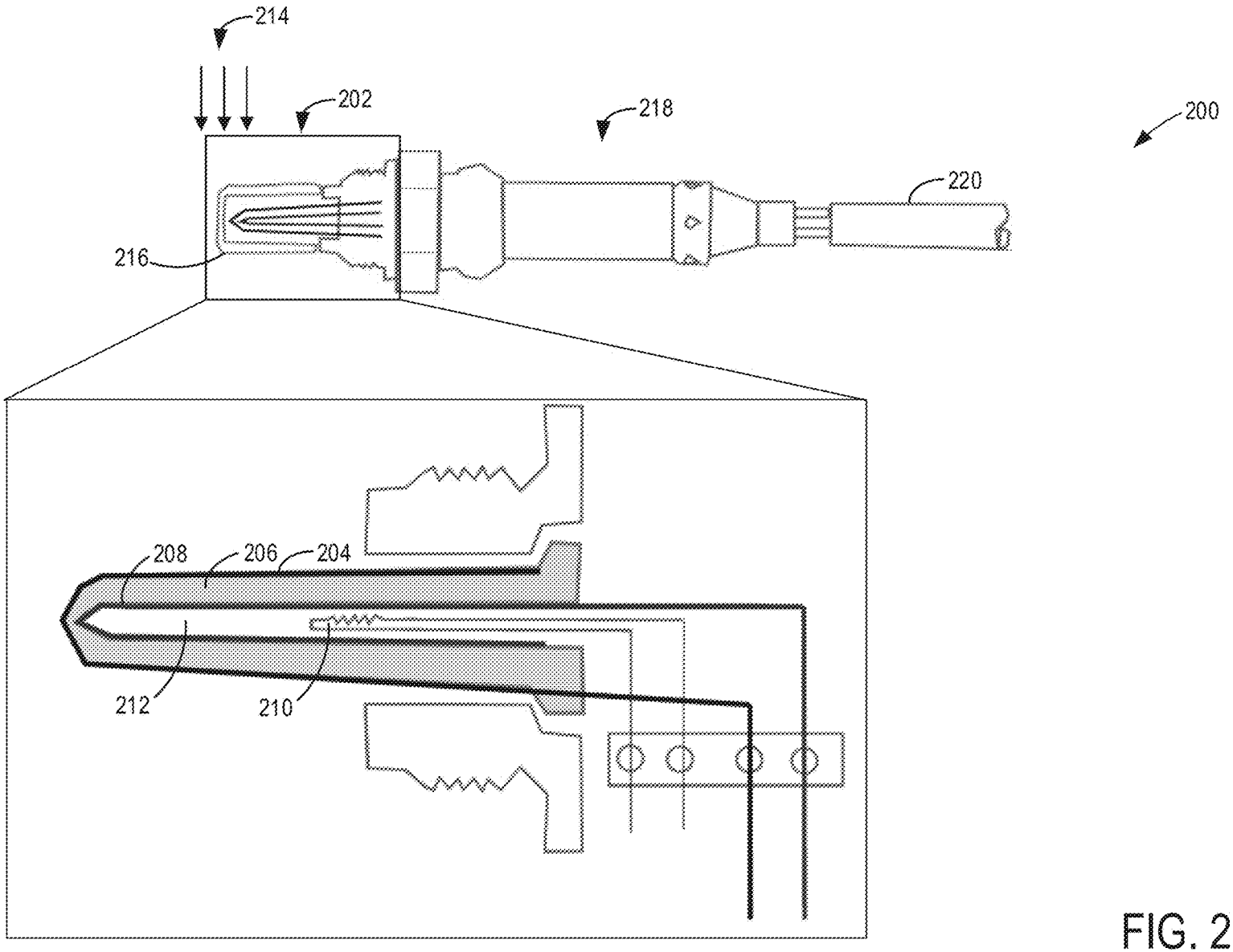
FIG. 2 shows a schematic diagram of an example oxygen sensor.

FIG. 2 shows a schematic view of an example embodiment of an air-referenced oxygen sensor 200 configured to measure a concentration of oxygen (02) in an intake airflow in an intake passage or an exhaust gas stream in an exhaust passage. In some examples, the sensor 200 may be a HEGO sensor as shown in FIG. 1, such as downstream sensor 128, for example. Hereafter, oxygen sensor 200 may be referred to as HEGO sensor 200.

As shown in FIG. 2, HEGO sensor 200 comprises a plurality of layers of one or more materials arranged in a stacked configuration. This plurality of layers is shown in further detail in view 202 which depicts an enlarged cross-section of the sensor tip of HEGO sensor 200 with a cap 216 removed. In the embodiment of FIG. 2, three layers are depicted, that include electrode layer 204 and electrode layer 208 separated by a solid electrolyte layer 206 capable of conducting ionic oxygen. The electrode layers 204 and 208 may be made of various suitable materials. In some embodiments, electrode layers 204 and 208 may be at least partially made of a material that catalyzes the dissociation of molecular oxygen. Examples of such materials include, but are not limited to, electrodes containing platinum and/or silver. Examples of suitable solid electrolytes that may comprise electrolyte layer 206 include, but are not limited to, zirconium oxide-based materials.

Further, in some embodiments, a heater 210 may be disposed in thermal communication with the layers to increase the ionic conductivity of the layers. While the depicted oxygen sensor is formed from three layers, it will be appreciated that the oxygen sensor may include other suitable numbers of layers for additional enhancements (e.g., specific catalyzing, additional diffusion, modify adsorption). Internal to the sensor tip shown in view 202 is a reference cell 212 that has a small inlet of ambient air that is sampled outside the exhaust system through a body 218 of HEGO sensor 200.

The pair of sensing electrode layers 204 and 208 detect a concentration gradient that may develop in electrolyte layer 206 due to an oxygen concentration in the exhaust gas that is higher than or lower than the stoichiometric level. A high oxygen concentration may be caused by a lean exhaust gas mixture, while a low oxygen concentration may be caused by a rich mixture. Electrode layer 208 is also exposed to ambient air that is present in reference cell 212. The ambient air is sufficiently heated by HEGO sensor 200, with the difference in concentration of oxygen molecules between the exhaust and ambient air driving oxygen ions from a higher to lower concentration thereby producing a voltage difference on the electrode layers 204 and 208. The farther apart in AFR the rich exhaust is as compared to ambient air with no reductants, the higher the voltage potential. If the ambient air contains some reductants, such as stray hydrogen, the voltage will be lower.

During engine operation, the exhaust stream 214 passes along HEGO sensor 200 and diffuses through electrolyte layer 206. Because the pressure and temperature within a vehicle's exhaust pipe is higher relative to that in HEGO reference cell 212 during engine operation, some penetration of hydrogen into reference cell 212 may occur at seals, interfaces, etc. of HEGO sensor 200 between reference cell 212 and the exhaust passage. Hydrogen is the smallest molecule generated within the exhaust stream and thereby more apt to diffuse into reference cell 212 than other generated molecules. Further, the concentration of hydrogen within the exhaust stream may build during sustained rich running or stoichiometric operations. Hydrogen in reference cell 212 may diffuse to ambient air via a breather tube 220 which couples reference cell 212 to ambient air. However, this diffusion takes time as hydrogen has to travel from reference cell 212 into breather tube 220, down the length of breather tube 220, and out into ambient air. Thus, the cross-sensitivity of HEGO reference cell 212 to hydrogen may bias HEGO sensor 200 output to report leaner conditions than actual as hydrogen alters reference cell 212 to actually be richer than the presumed lean ambient air without reductants, thereby generating a smaller voltage across layers 208 and 206. Further, any bias caused by hydrogen contamination in reference cell 212 may not be resolved until the concentration of hydrogen in reference cell 212 has diffused to ambient air. Accordingly, hydrogen diffusion into HEGO reference cell 212 may cause the fuel system to further richen the exhaust, thus compounding the problem of hydrogen generation.

Thus, according to embodiments disclosed herein, the diffusion of hydrogen into and out of reference cell 212 may be modeled, which can subsequently be used to offset potential HEGO sensor drift. A real-time model of HEGO sensor response to hydrogen in the exhaust gas may be used to compensate for hydrogen diffusion into reference cell 212 and correct fuel control in an open or closed loop manner during vehicle operation.

FIG. 3 depicts a physical model 300 of hydrogen infiltration into a HEGO reference cell 302. HEGO reference cell 302 is a non-limiting example of reference cell 212 of HEGO sensor 200 and is connected to a channel 304. Channel 304 holds a breather tube that attaches to HEGO reference cell 302 and spans the length of channel 304, terminating in ambient air 306. The breather tube may vent hydrogen out of reference cell 302 as shown in physical model 300. During engine operation, the exhaust stream (e.g., output from the engine and past one or more catalysts) may pass reference cell 302 as it exits the exhaust pipe.

The pressure and temperature of the exhaust gas in the exhaust pipe may be higher relative to the pressure and temperature in HEGO reference cell 302. This pressure and temperature differential may drive hydrogen diffusion across cracks and seals into reference cell 302 at the interface between reference cell 302 and the exhaust stream. Further, a pressure and temperature differential may exist between reference cell 302 and the gas in channel 304 and ambient air, which may drive hydrogen diffusion out of reference cell 302 into channel 304. This diffusion of hydrogen is depicted in the plot 308 of physical model 300.

Plot 308 depicts the diffusion of hydrogen from the exhaust stream into reference cell 302 and out of channel 304 into ambient air 306. The concentration of hydrogen (ppm), on the Y-axis, is shown as a function of distance, on the X-axis. The X-axis starts at distance point 0, or d0, which is a point within exhaust stream 214 just before reference cell 302. A first distance, d1, of plot 308 indicates the interface between the exhaust stream and reference cell 302. A second distance, d2, of plot 308 indicates the transition point from reference cell 302 to channel 304. A third distance, d3, of plot 308 indicates where channel 304 terminates in ambient air 306.

As shown in example plot 308, the hydrogen concentration 310 may be relatively high in the exhaust stream (e.g., from d0 to d1). The hydrogen concentration 310 from d1 to d2, while lower than the concentration in exhaust stream, is detectable as hydrogen diffuses into reference cell 302. The hydrogen concentration 310 may remain relatively stable, going from d1 to d2, showing a gradual decrease as hydrogen diffuses from reference cell 302 to channel 304 at d2. Hydrogen concentration 310 continues this decreasing trend as hydrogen diffuses through channel 304 and out into ambient air 306 at d3. From this understanding, by modeling the diffusion of hydrogen into HEGO reference cell 302 and the diffusion out of channel 304, the temporal responses of HEGO sensor offset due to hydrogen can be modeled and used to adjust engine fuel amounts, such as triggering intentional lean shifts. The physical model 300 of HEGO reference cell infiltration by hydrogen is further demonstrated in FIG. 4.

FIG. 4 shows a set of plots 400 illustrating the effect of hydrogen diffusion into an oxygen sensor reference cell, such as reference cell 302 of FIG. 3, on AFR during vehicle operation. A first plot 402 depicts vehicle speed (mph) 410 over time. A second plot 404 depicts vehicle exhaust pressure (inches Hg) 412 over time. A third plot 406 depicts vehicle exhaust temperature (° C.) 414 over time. A fourth plot 408 depicts sensed AFR 416, actual AFR 420, and the hydrogen effect on lambda 418 over time. All plots are time aligned as appreciated by the X-axis which is measured in seconds.

Following a tip-in, plot 402 shows an increase in vehicle speed 410 just after time point 1, or t1. As a result, exhaust pressure 412 increases and exhaust temperature 414 increases as indicated by spikes at t1 in plots 404 and 406, respectively. The sensed AFR 416, as determined by controller 12 based on output from an oxygen sensor, such as HEGO sensor 200, at t1 shows no fluctuation and remains steady around stoichiometry. However, the actual AFR 420, as determined by chemistry, shows that the AFR spiked rich just after the tip-in at t1. The same pattern may be observed at t2. At t2, an increase in vehicle speed 410 occurs, exhaust pressure 412 increases, exhaust temperature 414 increases, the sensed AFR 416 remains stable, and the actual AFR 420 spikes rich. Thus, as a result of the increased exhaust pressure 412 and exhaust temperature 414, and due to the rich spikes where hydrogen is generated by the engine and is present in the exhaust gas, hydrogen may diffuse into the HEGO reference cell causing bias within the oxygen sensor due to its cross-sensitivity to hydrogen. This bias is demonstrated by the differences between sensed AFR 416 and actual AFR 420 that is observed after t2.

Further, during the engine operation shown in plots 400 the commanded/setpoint air-fuel ratio is generally a long, sustained stoichiometric operation. Under these conditions, hydrogen is not purposely generated, but due to a small rich bias that allows the catalyst to consume engine NOx, enough hydrogen may be generated to accumulate in the exhaust gas and diffuse into the reference cell of the HEGO sensor. This hydrogen effect is most noticeable during steady state driving conditions with minimal rich spikes, as further described with respect to FIG. 7. As shown at t1 in plot 408, hydrogen diffusion into the reference cell biases HEGO sensor output to indicate a leaner exhaust gas than actual and less rich than the target AFR of controller 12 (FIG. 1), leading to a small correction that increases fuel supply to the engine and an increased difference between sensed AFR 416 and actual AFR 420. As operation is sustained going toward t2 and t3, hydrogen continues to be generated within the exhaust stream and the hydrogen continues to diffuse into the reference cell of the HEGO sensor. The hydrogen in the reference cell of the HEGO sensor results in an inaccurate reference oxygen concentration, which results in the HEGO sensor outputting a leaner-than-actual AFR. To bring the AFR back to target, controller 12 may command additional fuel be supplied to the engine. Over time, as shown between t2 and t3, the output of the HEGO sensor may indicate a near stoichiometric AFR (as shown by sensed AFR 416), yet the actual AFR may be rich (as shown by actual AFR 420). At t3, in response to a tip-out, sensed AFR 416 spikes lean whereas actual AFR 420 surges rich, then lean as fresh air passes through the engine due to deceleration fuel shutoff (DFSO) then surges rich again as combustion is restarted and excess carbon monoxide is used to reactivate the catalyst. The HEGO sensor appears to restore to correct operation temporarily, but a steady exhaust mass flow causes hydrogen to build within the HEGO sensor again leading the HEGO sensor to once again become desensitized to actual rich AFR.

At a fourth time point, t4, another DFSO event occurs, thus the exhaust mass flow will be lower when the engine returns to combustion (to operate the vehicle at a lower speed). At t4, a small initial rich surge occurs as shown by actual AFR 420, and, on reactivation of the catalyst, the HEGO sensor returns to expected operation. The buildup of hydrogen in the reference cell appears to be matched by the amount of breather tube diffusion at this sustained but lower exhaust mass flow. Thus, once hydrogen diffusion into the reference cell biases HEGO sensor output, continued hydrogen generation during steady state operation leads to further bias due to feedback control and/or an increased diffusion of hydrogen into the HEGO reference cell. Further, there may be a lag between when hydrogen in the exhaust gas decreases and/or is no longer generated and when the hydrogen in the reference cell and breather tube diffuses out to the ambient environment, and thus even after hydrogen is no longer generated, the HEGO sensor may continue to exhibit bias until the hydrogen in the reference cell dissipates. Additionally, once the hydrogen effect is initiated and more rich conditions develop, other reductants (such as ammonia) may coat HEGO sensor surfaces, further desensitizing the sensor. Thus, the desensitizing effects of other reductants have to dissipate before the HEGO sensor can be restored to functioning without bias.

Thus, hydrogen may be generated during rich AFR conditions and when the fueling system never goes lean, the lack of oxygen washing over the layers of chemistry on the catalyst brick allows the hydrogen concentration to build up in the exhaust system. For example, the engine may periodically be run rich to generate ammonia for a downstream, passive SCR device (e.g., SCR device 152). If the engine operates for a sustained period following the rich operation without swinging lean, the hydrogen in the exhaust gas may begin to infiltrate the HEGO sensor. The temperature and pressure in the exhaust drive a diffusion of hydrogen into the reference cell, which causes a further rich bias and yet higher hydrogen levels. These are the same conditions where un-wanted reactions can take place like the reduction of hydrogen with nitrogen forming ammonia. (It is to be noted that while ammonia may be generated by the TWC via reaction with hydrogen and then stored in the SCR device under certain conditions to facilitate reduction of NOx, and thus it may be desirable to generate hydrogen during some conditions, hydrogen and hence ammonia generation beyond what can be used by the SCR device may not be desired, and if the SCR device is not equipped to store/utilize the ammonia, hydrogen generation may be avoided).

When the exhaust has a high, always positive hydrogen concentration, any diffusion of hydrogen into the HEGO reference cell causes the fuel system to further richen the exhaust compounding the problem. Normally the hydrogen is flushed from the system by periodic lean swings due to hydrogen's affinity to oxygen, particularly in the catalyst. However, in highly steady load conditions, the hydrogen and fuel system reaction can gradually drift. To further compound the problem, under these rich conditions when ammonia is being generated much larger quantities of hydrogen are generated, making the problem even worse.

As will be explained in more detail below, during certain conditions where hydrogen is predicted to be in the exhaust gas, the diffusion of hydrogen into the reference cell of the HEGO sensor may be modeled in order to estimate an amount of hydrogen in the reference cell and an effect of that hydrogen on the output of the HEGO sensor. However, as explained above with respect to FIG. 3, the reference cell may comprise a relatively large volume (e.g., relative to the breather tube) and thus the hydrogen may enter the reference cell faster than the hydrogen may exit the reference cell, allowing hydrogen to build in the reference cell. Thus, model described herein may also model the rate of diffusion of hydrogen out of the reference cell, which may allow for an instantaneous estimation of hydrogen concentration in the reference cell to be determined, that takes into account the amount of hydrogen that may have already diffused into the reference cell but has not yet diffused out of the reference cell.

Figure 5:
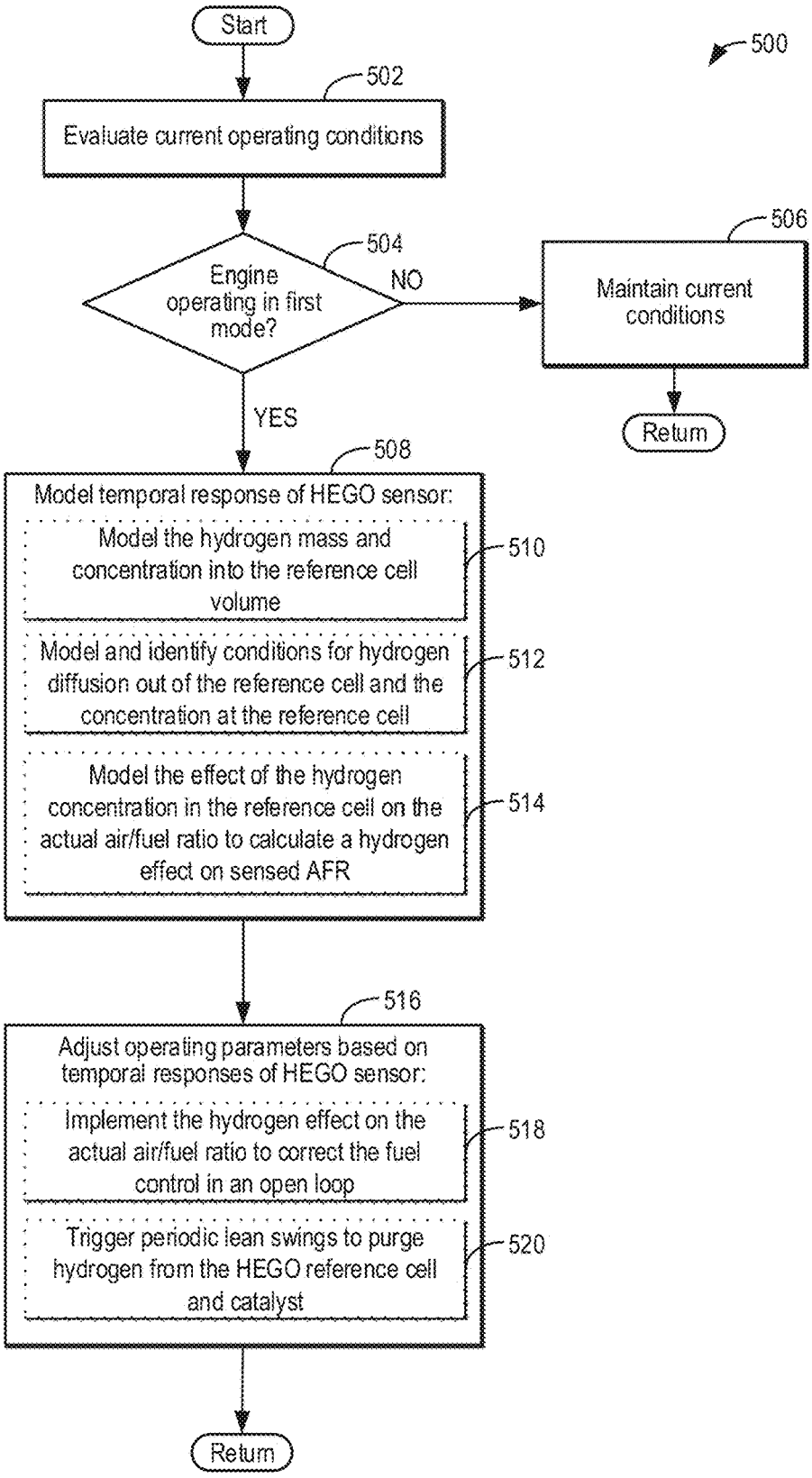
FIG. 5 provides a flow chart illustrating a method for utilizing hydrogen diffusion modeling to estimate a hydrogen amount in the reference cell of a HEGO sensor in a temporal manner and adjusting fuel injection amounts based on the estimated hydrogen amount.

FIG. 5 is a flow chart showing a method 500 for using hydrogen diffusion modeling to create a temporal model of HEGO sensor responses to generate closed or open loop bias corrections on AFR in accordance with the current disclosure. Instructions for carrying out method 500 and the rest of the methods included herein may be executed by a controller (e.g., controller 12 of FIG. 1) based on instructions stored on a memory of the controller and in conjunction with signals received from sensors of the engine system, such as the sensors described above with reference to FIG. 1 (e.g., sensor 128 of FIG. 1 and/or HEGO sensor 200 of FIG. 2). The controller may employ engine actuators of the engine system to adjust engine operation (e.g., adjust engine fuel amounts by adjusting fuel injector 66 of FIG. 1), according to the methods described below.

Method 500 may begin at 502. At 502, method 500 may include evaluating current operating conditions. As non-limiting examples, operating conditions may include engine operating status, engine speed, engine load, engine temperature, combustion AFR, mass air flow (e.g., as determined from MAF sensor 120), HEGO sensor data (e.g., output from HEGO sensor 200), engine coolant temperature, catalyst temperature, fuel control, etc.

At 504, method 500 determines, based on the evaluated operating conditions, if the engine is operating in a first mode where correction the output from the HEGO sensor due to hydrogen is to be enabled. The first mode may include steady state operating conditions in which hydrogen is generated. Hydrogen may be generated during sustained rich running conditions which may occur when the engine is cold, accelerating, or under a load, and/or when ammonia formation over a TWC is desired. Alternatively, rich running may also result from dirty air filters, stuck open injectors, or faulty sensors. In some examples, hydrogen may be generated during sustained stoichiometric conditions, or conditions where the engine has not operated lean for a threshold amount of time. In some examples, operation in the first mode may include AFR changing by less than a threshold amount over a predetermined time period, the engine fuel amounts being controlled in closed loop feedback control, and a commanded or setpoint AFR being less than a minimum AFR, such as a lambda of less than 0.999 LAM. If operation in the first mode is detected, method 500 may then continue to 508, which is described in more detail below. If operation in the first mode is not detected, method 500 may continue to 506.

At 506, the engine may be operating in a second mode where correction of the output from the HEGO sensor due to hydrogen is not enabled, and thus current vehicle operating conditions are maintained and method 500 may return to 502. Maintaining the current vehicle operating conditions may include receiving voltage signals from the HEGO sensor and adjusting AFR accordingly, without the AFR sensed by the HEGO sensor being corrected by a modeled hydrogen effect. In some examples, such as when the engine fuel is not controlled in a closed loop manner, the output from the HEGO sensor may be ignored and thus any correction to the output may be moot.

At 508, a model of the temporal responses of the HEGO sensor to hydrogen may be determined by modeling hydrogen diffusion into and out of the HEGO reference cell. Determining the model may include, at 510, modeling the mass and concentration of hydrogen into the volume of the HEGO reference cell. In an example, modeling the mass and concentration of hydrogen into the volume of the HEGO reference cell may include empirically determining the composition of the gas mixture within the reference cell and determining the proportional percent of the mixture that is occupied by hydrogen during different operational conditions as compared to that to of a reference standard, and storing the hydrogen mass and/or concentration in a look-up table that is indexed by air fuel ratio, exhaust pressure, and/or exhaust temperature. Then, during execution of method 500, current exhaust pressure and exhaust temperature may be determined (e.g., based on output from sensor 148 and sensor 150, respectively, of FIG. 1) and a pressure difference (dP) between the exhaust pressure and ambient pressure and a temperature difference (dP) between the exhaust temperature and ambient temperature may be calculated. Ambient pressure and temperature may be based on onboard sensors (e.g., based on the output of sensors 148 and 150 of FIG. 1), GPS, weather service information, or another suitable source. The dP and dT may be entered into the look-up table to determine the mass flow of hydrogen into the reference cell. The concentration of hydrogen in the reference cell may be determined by subtracting the mass flow of hydrogen out of the reference cell (explained in more detail below) from the mass flow of hydrogen into the reference cell and dividing by the volume of the reference cell.

Further, determining the model may include, at 512, modeling and identifying conditions for hydrogen diffusion out of the HEGO reference cell and the concentration at the reference cell. The rate of hydrogen diffusion may be modeled by determining the rate of hydrogen diffusion from the reference cell in relation to the volume and dimensions of the reference cell and the breather tube as a function of varying temperatures and pressures along the diffusion pathway. For example, the mass flow of hydrogen out of the reference cell may be determined by entering the hydrogen concentration in the reference cell (determined as explained above) into a look-up table that stores hydrogen mass flow out of the reference cell as a function of hydrogen concentration and a length of the reference cell and/or breather tube.

Determining the model may also include, at 514, modeling the effect of the hydrogen concentration in the reference cell on actual AFR. The effect of the hydrogen concentration in the reference cell may be determined by entering the percent of hydrogen present within the reference cell into a look-up table, which may store an expected effect on oxygen sensor output and/or AFR as a function of the hydrogen concentration. The look-up table may be populated during vehicle manufacture or otherwise offline based on observed effects of reference cell hydrogen concentration and the actual AFR over a length of time during a designated drive cycle. The effect of the hydrogen on the sensed AFR may be quantified as a hydrogen effect correction factor, also referred to as a hydrogen effect, that may be applied to the AFR sensed by the HEGO sensor.

At 516, method 500 may include adjusting the operating parameters based on the model of temporal responses of the HEGO sensor (e.g., based on the hydrogen effect) determined at 508. Adjusting the operating parameters may include, at 518, implementing the hydrogen effect on the actual AFR to correct the fuel control, which may include triggering an open loop response that adjusts fuel control based on the determined hydrogen effect. In an open loop response, there is no feedback control and oxygen sensor data is ignored so the engine may be managed to run at AFRs other than stoichiometry. For example, the controller may control the fuel injectors to adjust engine fuel amounts without relying on feedback from the HEGO sensor. However, the open loop control may rely on an offset that is learned during closed loop control, and thus in some examples this offset may be adjusted based on the hydrogen effect. In still further examples, the hydrogen effect may be used to directly adjust the AFR sensed by the HEGO sensor during closed loop control. While these approaches may proactively respond to the hydrogen and result in accurate AFR control, these approaches also assume that the hydrogen effects acts on the system with little variability. Thus, in some examples, adjusting the operating parameters based on the model may include, at 520, triggering a lean swing to purge hydrogen from the HEGO reference cell and catalyst. This approach may be more conservative and may include triggering a brief shift in a scheduled rich AFR to a value that is closer to stoichiometry to counteract the hydrogen effect, if such a shift (including a DFSO event) has not occurred from active drive-induced AFR scheduling changes. This may benefit both open loop fuel operation (which uses an offset that is adaptively learned during steady state closed loop operation) and closed loop control (which uses post-catalyst HEGO sensor feedback). This conservative approach only briefly alters AFR scheduling to a more stoichiometric set point, which may be sufficient for steady state operation, though the brief swing to a more stoichiometric AFR may be calibrated with respect to limiting NOx production/emissions.

The lean swing to purge hydrogen from the HEGO reference cell and catalyst may cause reduction of the oxygen in the exhaust gas by the hydrogen via a catalyst (e.g., device 70 of FIG. 1), forming water which may pass safely through the exhaust pipe into the atmosphere. The lean (relatively less rich) fuel shifts triggered at 520 may be calibratable and torque compensated thereby allowing for the hydrogen to diffuse out of the HEGO sensor without affecting vehicle operation. For example, the lean swing may be set for the minimum amount of time required to allow hydrogen to diffuse out the reference cell while keeping NOx emissions under a set target and still delivering requested torque. In some examples, the duration of the lean swing and/or AFR during the lean swing (e.g., the amount of leanness of the exhaust gas) may be selected based on the current hydrogen concentration in the reference cell and/or based on the current mass flow of hydrogen out of the reference cell. In some examples, the lean swing may be triggered in response to the hydrogen effect determined by the model having an absolute value that is greater than a threshold, which may indicate that a large amount of hydrogen is present in the exhaust gas, catalyst, and/or reference cell and may need additional oxygen to purge the hydrogen from the system. Method 500 may then return to 502.

Figure 6A:
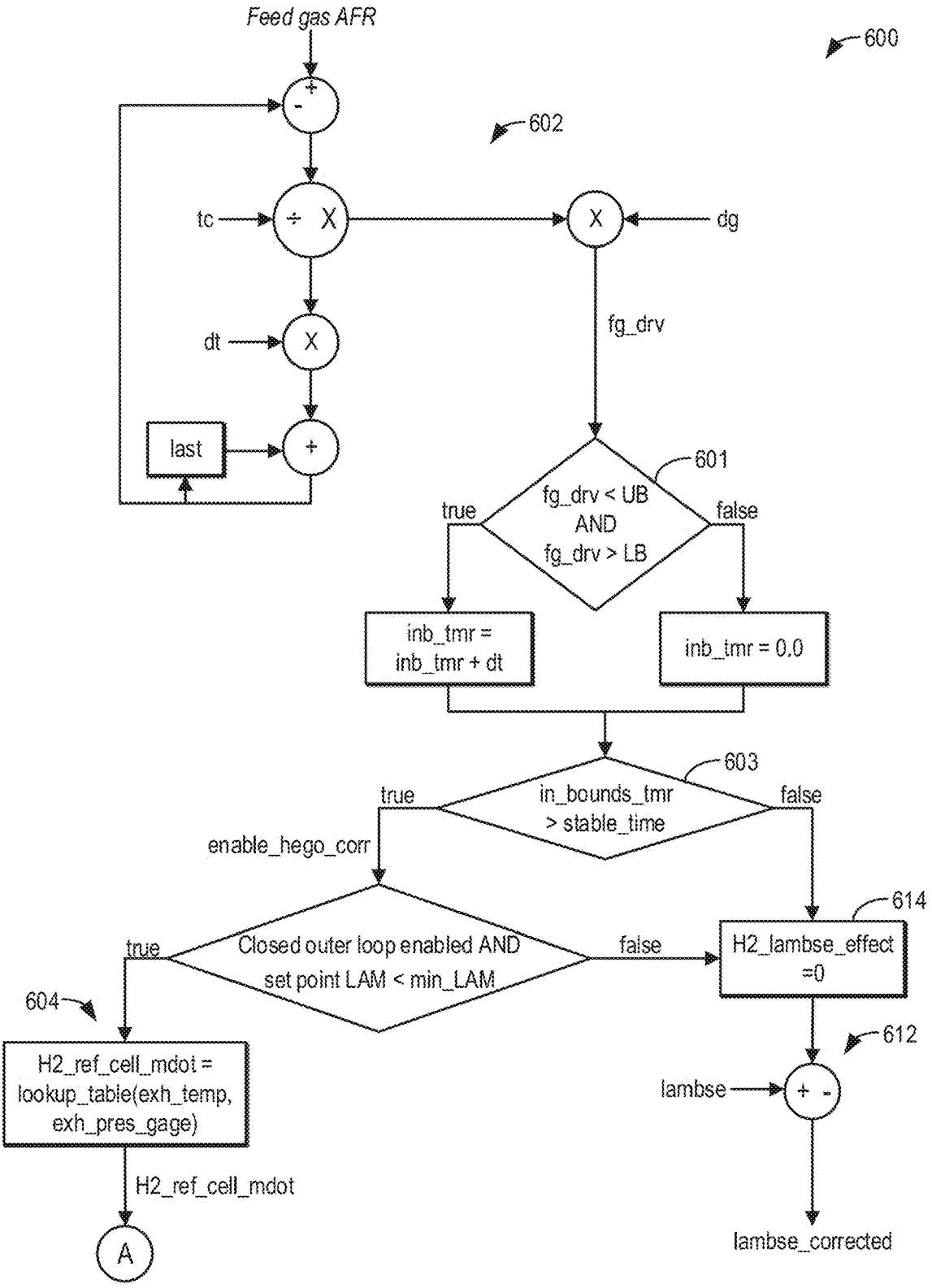
FIG. 6A shows a first part of a control diagram depicting air-fuel ratio control according to the method of FIG. 5.
Figure 6B:
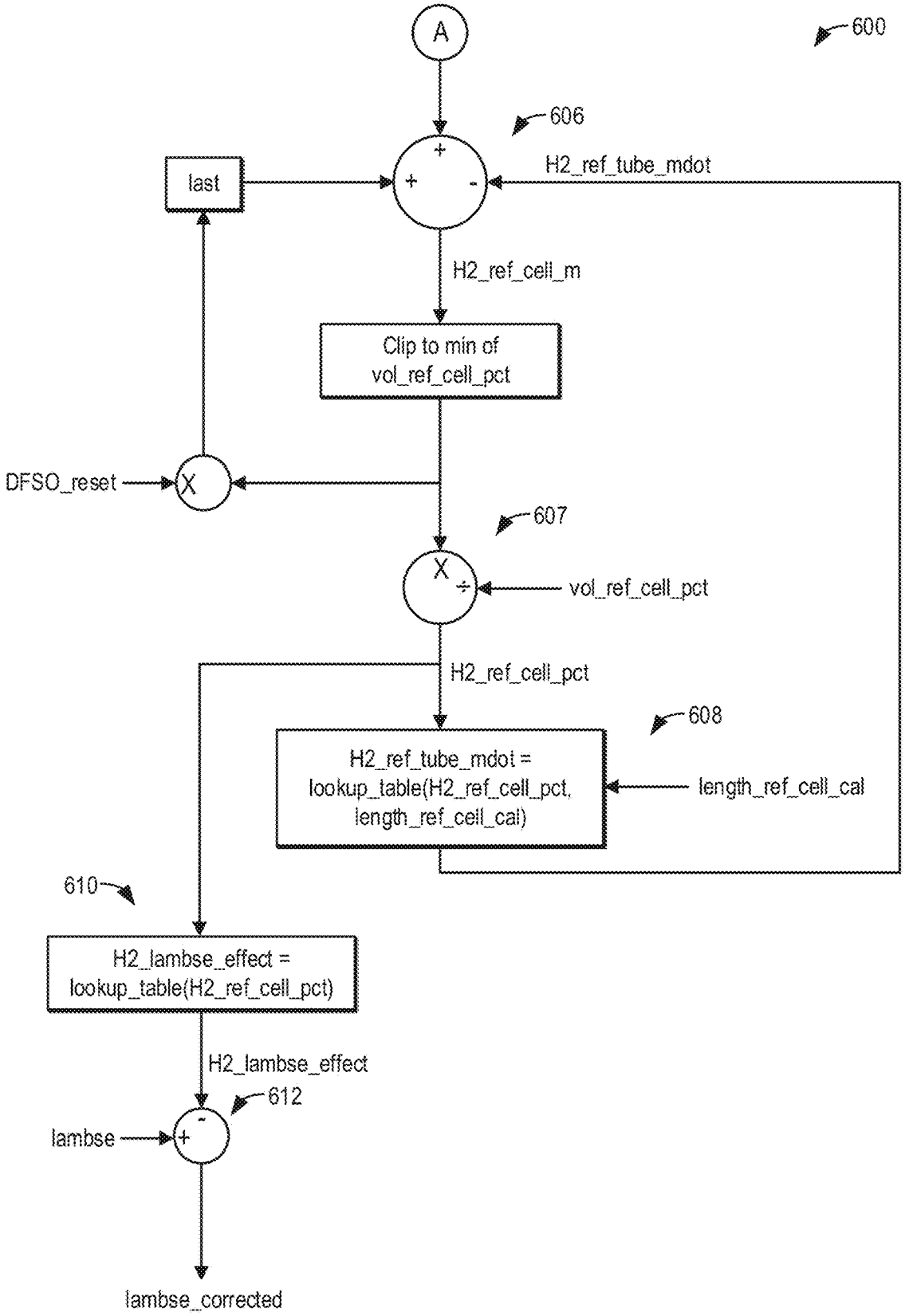
FIG. 6B shows a second part of the control diagram presented in FIG. 6A.
Figure 7:
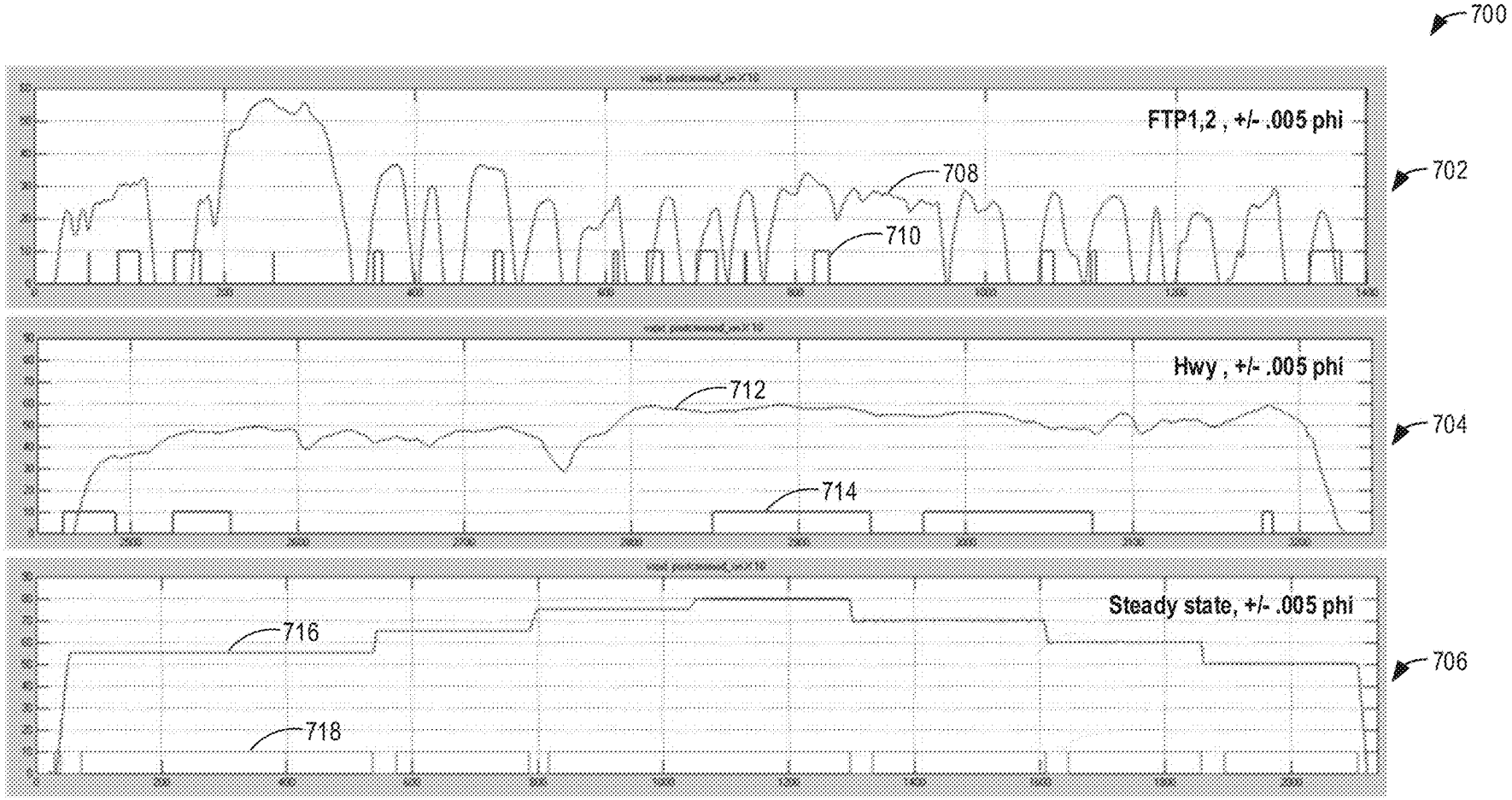
FIG. 7 shows a series of plots illustrating instances of air-fuel ratio control due to modeled hydrogen over a series of drive cycles.

FIGS. 6A and 6B show a control diagram 600 graphically depicting a detailed example of method 500 presented in FIG. 5. Control diagram 600 will be described herein with reference to the components and systems depicted in FIGS. 1 and 2, though it should be understood that the control diagram may be applied to other systems without departing from the scope of this disclosure. Control diagram 600 may be carried out by controller 12, and may be stored as executable instructions in non-transitory memory.

Control diagram 600 includes a first portion 602 where control diagram 600 determines if HEGO sensor output should be corrected for the effect of hydrogen diffusion into reference cell 212 based on the change in the feedgas AFR over time and a setpoint (e.g., schedule) AFR. In the example shown, control diagram 600 determines the derivative of the feedgas AFR (which may be determined based on output from an upstream oxygen sensor positioned upstream of the catalyst and upstream of the HEGO sensor, such as sensor 126 of FIG. 1) and determines if the derivative is between an upper boundary (UB) and a lower boundary (LB) at block 601. If the derivative is between the UB and the LB (e.g., "true" in FIG. 6A), an inbounds timer is set to inb_tmr+dt (where inb_tmr is an inbounds timer and dt is the time between the updates of method 600) and if the derivative is not between the UB and the LB (e.g., "false" in FIG. 6A), the inbounds timer is set to zero. At block 603, the inbounds timer is compared to a stable time threshold. If the inbounds timer is greater than the stable time threshold, the HEGO sensor correction is enabled and a determination is made at 605 whether closed outer loop fuel control is enabled and the setpoint lambda is greater than a minimum lambda. The minimum lambda may be an experimentally determined value where at prolonged steady state operation, the HEGO sensor becomes desensitized to rich operation, which could begin at rich values such as 0.999 LAM. If not, the lambda effect is set to zero at 614 and sensed AFR from the HEGO sensor is not corrected.

If HEGO sensor correction is not enabled (e.g., because the inbounds timer is not greater than the stable time threshold), the HEGO output does not need to be corrected (e.g. the AFR is continually shifting therefore hydrogen is not expected to be generated in the exhaust, the scheduled AFR is too high, etc.), the hydrogen effect on sensed lambda (where sensed lambda may be referred to as LAMBSE) is set to zero at 614. After 614, LAMBSE is corrected at corrector block 612 based on the determined hydrogen effect. When the determined hydrogen effect is set to zero as described above, LAMBSE is not corrected.

If closed outer loop fuel control is enabled and the setpoint lambda is greater than a minimum lambda, control diagram 600 continues at 604. At 604, the mass flow (m) of hydrogen into the reference cell is determined using a look-up table programmed with reference values for hydrogen mass flow indexed as a function of the temperature and pressure within the exhaust pipe relative to ambient temperature and pressure (e.g., a temperature difference (dT) and a pressure difference (dP)). Subsequently, at block 606 (shown in FIG. 6B), the mass of hydrogen in the reference cell (H2_ref_cell_m) and the percent of total volume occupied by hydrogen within the reference cell (also referred to as the hydrogen concentration) is determined at block 607. The mass of hydrogen in the reference cell may be determined by subtracting the mass flow of hydrogen out of the reference cell (determined at block 608 and described in more detail below) from the mass flow of hydrogen into the reference cell.

In some examples, the mass of hydrogen that is output from block 606 may be fed back to block 606 (after being clipped to the minimum of a hydrogen concentration) and added to the mass of hydrogen determined in a subsequent iteration of the control diagram (e.g., from an immediately subsequent point in time). For example, the control diagram may be executed at a predetermined frequency (e.g., 10 Hz), and the output from block 606 at a first point in time may be added to the output from block 606 at a second point in time (e.g., one-tenth of a second later). Doing so may provide for the mass of hydrogen currently determined to be in the reference cell to be combined with the mass of hydrogen previously determined to be in the reference cell, which may at least in part account for the accumulation of hydrogen that may occur due to the diffusion rate out of the reference cell being lower than the diffusion rate into the reference cell.

In such examples, the feedback of the prior mass of hydrogen may be multiplied by a DFSO reset value that is set to either one or zero, dependent on the length of time since the last DFSO event. During DFSO, no fuel is injected while the engine pumps air through the catalyst. Following a DFSO event, the HEGO sensor may return to normal operation and there is a predictable space of time before the hydrogen effect re-asserts itself if the qualifying conditions are still present (e.g., steady state operation with setpoint AFR at or below the threshold AFR). As mentioned previously, a post-DFSO fuel system operation, referred to as catalyst reactivation, may inadvertently hasten the return of the hydrogen effect; however, this is considered in the DFSO reset time, which may elapse in order for method 600 to return to 606. To that end, an incrementing timer may be triggered when a DFSO event ends and reset upon beginning the next DFSO event. If the timer has not passed a threshold time, the DFSO reset value may be set to zero, while if the timer has passed the threshold time, the DFSO reset value may be set to one, indicating that enough time has elapsed since the last DFSO event to allow the hydrogen effect to re-start. Output of block 606 at the DFSO reset feeds back from the previous loop iteration. The next iteration flows through and the total mass of hydrogen within the reference cell is then determined based on the m of hydrogen into the reference cell for the current iteration and the mass of hydrogen within the reference cell from the previous iteration.

The mass of hydrogen in the reference cell that is output from block 606 may be converted to a hydrogen concentration (or a percent volume of the reference cell that is occupied by hydrogen, vol_ref_cell_pct) at 607. The mass of hydrogen in the reference cell is divided by the volume of the reference cell to determine the hydrogen concentration (or mass per volume of the hydrogen) in the reference cell. The example shown in the current disclosure uses a percent volume of the reference cell; however, in other examples, the mass of hydrogen in the reference cell may be entered into the look-up table rather than first converting the mass to a concentration.

At block 608, the m of hydrogen out of the reference cell is determined using a look-up table programmed with reference values for hydrogen m indexed as a function of the percent of total volume within the reference cell occupied by hydrogen and calibrated for the total length of the reference cell and the breather tube. The output of block 608 is fed back to block 606, as described above.

At block 610, control diagram 600 includes determining a predicted effect of hydrogen diffusion into and out of the reference cell on LAMBSE (e.g., the sensed AFR relative to stoichiometric AFR), referred to in the control diagram as H2_lambse_effect. This effect may be determined using a look-up table programmed with H2_lambse_effect values as a function of the percentage of the volume of the reference cell occupied by hydrogen. Once the effect of hydrogen diffusion into the reference cell on LAMBSE has been determined, control diagram 600 may continue at 612. At 612, LAMBSE may be corrected so that the commanded AFR is based on an accurate determination of exhaust AFR. The sensed lambda (e.g., as sensed from the output of the HEGO sensor) may be corrected with the hydrogen lambse effect determined at block 610 by subtracting the hydrogen lambse effect from the LAMBSE.

An example hydrogen lambse effect 418 is shown in plot 408 of FIG. 4. In FIG. 4, the calculated hydrogen lambse effect 418 is added to one, so that the effect can be plotted on the scale of plot 408. If hydrogen lambse effect 418 was correcting LAMBSE (shown by sensed AFR 416 in FIG. 4), a drift would not be observable between sensed AFR 416 and actual AFR 420 going from time point t1 to t2 in FIG. 4. Additionally, since the sensed lambda from the HEGO sensor is stoichiometric, the effect shown in FIG. 4 also shows how the sensed lambda would be corrected. For example, if the lambda were corrected as shown, the rich AFR would be mitigated or reduced because the controller would know not to add additional fuel to the engine. As previously described with respect to FIG. 4, fresh air passing through the engine during DFSO (e.g., at time t3) restores HEGO functioning. However, the hydrogen effect is still capable of forming after DFSO, which occurs after t3. At t4, the hydrogen effect has ended, as the exhaust mass flow/pressure is low enough to restore normal operation.

FIG. 7 shows a series of plots 700 illustrating example incidences in which the model described above with respect to FIGS. 5, 6A, and 6B would have corrected for HEGO sensor bias resulting from hydrogen diffusion into a HEGO sensor reference cell. Plots 700 depict vehicle speed as a function of time under three different types of drive cycles as well as incidences in which the hydrogen diffusion model would have output a non-zero hydrogen effect correction factor (also referred to as a hydrogen lambse effect). A first plot 702 depicts vehicle speed in curve 708 and model correction for HEGO sensor bias in curve 710 as a function of time under a Federal Test Procedure (FTP) drive cycle. A second plot 704 depicts vehicle speed in curve 712 and model correction for HEGO sensor bias in curve 714 as a function of time under Highway Fuel Economy emissions testing conditions. A third plot 706 depicts vehicle speed in curve 716 and model correction for HEGO sensor bias in curve 718 as a function of time during steady state vehicle emissions testing.

The FTP depicted in plot 702 is a drive cycle that mimics city driving or stop and go traffic as demonstrated by consistent increases and drops in vehicle speed. Under the driving conditions in plot 702, the model correction for HEGO sensor bias occurred fourteen times (mostly due to engine idling) over the course of 1400 seconds. The model correction shown in the plots 700 only indicates whether or not the model correction would have been implemented to correct the output of the HEGO sensor, and does not indicate a relative value of the correction, which for lower mass flows/pressures may be zero.

The Highway Fuel Economy emissions testing in plot 704 is a drive cycle that mimics highway driving conditions under sixty mph as demonstrated by the vehicle speed shown by curve 712. Under the driving conditions in plot 704, the model correction for HEGO sensor bias occurred five times over the course of 3200 seconds, as shown by curve 714.

The steady state vehicle emissions testing in plot 706 is a drive cycle that mimics a high engine load on a 0% grade of incline as demonstrated by the vehicle speed shown by curve 716. Under the driving conditions in plot 706, the model correction for HEGO sensor bias occurred six times over the course of 2000 seconds, as shown by curve 718. During steady state vehicle emissions testing, the engine is operating in a steady state condition which allows for hydrogen generation over relatively long periods of time, and thus the model correction for HEGO sensor bias shown by curve 718 occurs for longer durations as compared to drive cycles that include lean swings such as shown in plot 702.

FIGS. 1-2 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In this way, HEGO sensor output bias caused by hydrogen diffusion into the reference cell of the HEGO sensor may be overcome according to the systems and methods described herein. The embodiments disclosed herein allow the effect of the hydrogen on the sensed AFR to be quantified as a hydrogen effect correction factor that may be applied to the AFR sensed by the HEGO sensor and the AFR subsequently adjusted toward near stoichiometry. By applying the hydrogen correction factor, potential HEGO sensor bias on sensed AFR caused by hydrogen diffusion into the HEGO sensor reference cell may be corrected without introducing an expensive, dedicated catalyst to remove hydrogen from the exhaust stream. Further, the method presented herein allows the sensed AFR to be corrected in real-time thereby improving overall fuel economy. The technical effect of identifying and compensating for HEGO sensor drift by modelling hydrogen diffusion into and out of the sensor's reference cell is that sensed AFR may be corrected in real-time thereby maintaining efficient combustion and reduced emissions.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

adjusting a fuel amount supplied to an engine based on an estimated amount of hydrogen in a reference cell of an oxygen sensor positioned in an exhaust passage coupled to the engine, wherein adjusting the fuel amount based on the estimated amount of hydrogen in the reference cell comprises estimating the amount of hydrogen in the reference cell based on a mass flow of hydrogen into the reference cell and a mass flow of hydrogen out of the reference cell.

2. The method of claim 1, wherein the mass flow of hydrogen into the reference cell is determined based a pressure difference between a pressure in the exhaust passage and ambient pressure and a temperature difference between a temperature in the exhaust passage and ambient temperature, and wherein the reference cell is coupled to ambient via a breather tube.

3. The method of claim 2, wherein the mass flow of hydrogen out of the reference cell is determined based on a previous estimated amount of hydrogen in the reference cell and a length of the breather tube.

4. The method of claim 1, wherein adjusting the fuel amount supplied to the engine based on the estimated amount of hydrogen in the reference cell comprises adjusting a sensed air-fuel ratio sensed by the oxygen sensor based on the estimated amount of hydrogen in the reference cell and adjusting the fuel amount supplied to the engine based on the adjusted sensed air-fuel ratio in order to maintain stoichiometric air-fuel ratio.

5. The method of claim 1, wherein adjusting the fuel amount supplied to the engine based on the estimated amount of hydrogen in the reference cell comprises, when the estimated amount of hydrogen exceeds a threshold amount, decreasing the fuel amount supplied to the engine by one or more of a specified amount and for a specified duration.

6. The method of claim 5, wherein one or more of the specified amount and specified duration are selected based on one or more of an engine torque request and the estimated amount of hydrogen in the reference cell.

7. The method of claim 1, further comprising reducing NOx in exhaust gas generated by the engine via a passive SCR device positioned downstream of the oxygen sensor, including reducing the NOx with ammonia generated by a three-way catalyst positioned upstream of the oxygen sensor.

8. A system, comprising:

an engine including a cylinder and a fuel injector coupled to the cylinder;

an exhaust passage coupled to the engine;

an oxygen sensor positioned in the exhaust passage, the oxygen sensor including a reference cell coupled to ambient via a breather tube; and a controller storing instructions in non-transitory memory executable by one or more processors to adjust an amount of fuel supplied by the fuel injector based on an estimated amount of hydrogen in the reference cell of the oxygen sensor, wherein the instructions are executable to estimate the amount of hydrogen in the reference cell based on an estimated mass flow of hydrogen into the reference cell and an estimated mass flow of hydrogen out of the reference cell.

9. The system of claim 8, wherein the mass flow of hydrogen into the reference cell is determined based a pressure difference between a pressure in the exhaust passage and ambient pressure and a temperature difference between a temperature in the exhaust passage and ambient temperature.

10. The system of claim 9, wherein the mass flow of hydrogen out of the reference cell is determined based on a previous estimated amount of hydrogen in the reference cell and a length of the breather tube.

11. The system of claim 8, wherein adjusting the amount of fuel supplied by the fuel injector based on the estimated amount of hydrogen in the reference cell comprises adjusting a sensed air-fuel ratio sensed by the oxygen sensor based on the estimated amount of hydrogen in the reference cell and adjusting the amount of fuel supplied by the fuel injector based on the adjusted sensed air-fuel ratio.

12. The system of claim 8, wherein adjusting the amount of fuel supplied by the fuel injector based on the estimated amount of hydrogen in the reference cell comprises, when the estimated amount of hydrogen exceeds a threshold amount, decreasing the amount of fuel supplied by the fuel injector by one or more of a specified amount and for a specified duration.

13. The system of claim 8, further comprising a three-way catalyst positioned upstream of the oxygen sensor and a passive SCR device positioned downstream of the oxygen sensor, and wherein exhaust gas from the engine does not pass through a NOx trap before being released to atmosphere.

* * * * *